US005100258A

United States Patent [19]

VanWagoner

[11] Patent Number: 5,100,258

[45] Date of Patent: Mar. 31, 1992

[54] DRAINAGE QUILT

[76] Inventor: John D. VanWagoner, 8554 Georgetown Pike, McLean, Va. 22102

[21] Appl. No.: 623,057

[22] Filed: Dec. 6, 1990

[51] Int. Cl.[5] ..... E02B 11/00

[52] U.S. Cl. ..... 405/45; 405/43; 405/50; 405/36

[58] Field of Search ..... 405/43, 44, 45, 50, 405/36

[56] References Cited

U.S. PATENT DOCUMENTS

| | | | |
|---|---|---|---|
| 3,233,414 | 2/1966 | Hansen, Jr. et al. | 405/50 |
| 4,309,855 | 1/1982 | Pate et al. | 405/45 X |
| 4,330,222 | 5/1982 | Klein | 405/43 X |
| 4,411,555 | 10/1983 | Minvielle et al. | 405/50 |
| 4,538,386 | 9/1985 | DiCello | 405/43 X |
| 4,572,700 | 2/1986 | Mantarro et al. | 405/45 X |
| 4,662,778 | 5/1987 | Dempsey | 405/50 X |
| 4,840,515 | 6/1989 | Freese | 405/43 X |
| 4,869,032 | 9/1989 | Geske | 405/43 X |
| 4,877,350 | 10/1989 | DiFiore | 405/43 X |
| 4,934,865 | 6/1990 | Varkonyi et al. | 405/43 X |

*Primary Examiner*—Randolph A. Reese
*Assistant Examiner*—J. Russell McBee
*Attorney, Agent, or Firm*—Bradford E. Kile

[57] ABSTRACT

A drainage quilt which operably rests adjacent to a subterranean conduit and facilitates water removal and dispersal from underground drainage sites. The drainage quilt includes a water permeable membrane configured in a generally rectangular container and a plurality of drainage members disposed within the container. The drainage members are composed of recycled or new plastic or chunks of old rubber tires and are positioned in a homogeneous fashion to create drainage channels through the subject quilt. Flexible positioning ties extend perpendicularly through the rectangular container to retain the relative positioning of the drainage members. The ties prevent the drainage members from assembling at any one area of the drainage quilt and thus encourage an equal distribution of fluid flow throughout the quilt.

12 Claims, 4 Drawing Sheets

DRAINAGE QUILT

BACKGROUND OF THE INVENTION

This invention relates to a novel drainage quilt for use in a subterranean drainage system. More specifically, this invention relates to a filtered drainage quilt which may be used for removing water from soil around subterranean walls, for distributing water into leach, drainage or irrigation fields, and for a number of other uses where it is necessary to relieve or redirect water and other fluid flow.

When constructing a house or a building with subterranean walls, it is necessary to install a system which facilitates drainage of water away from the subterranean walls. Water must not sit near the foundation of the structure because, over time, the water can degrade the integrity of some waterproofing membranes or damproofing and leak into interior spaces. Most foundations are made of cinder block or poured or precast concrete, and waterproofed with various bituminous or rubber waterproofing membranes or bituminous damproofing materials. The presence of hydrostatic pressure encourages leakage of water through any void or weakness in the membrane or dampproofing, through sub-grade walls and floors to the interior of habitable spaces rendering them nonusable.

Different sources of water which could contribute to the presence of hydrostatic pressure include ground, surface, and roof and gutter water. Ground water must be taken into account when designing below grade spaces. It can be at different elevations at different times of the year. Surface water, generally the largest amount of water that needs to be controlled, comes from rain, melting snow, and drainage from other areas of the building site. Surface water may be diverted away from a house by building the structure on a high point. Additionally, the land surrounding the building is sloped downward in order to direct water away from the building. However, some amount of surface water seeps into the ground, and if not dealt with, will cause or add to hydrostatic pressure buildup.

Roof and gutter water may be routed away from the house in two ways: dispersed on the surface away from the building or piped away underground. Surface dispersal is attractive because it is easy to monitor; most problems that may occur are noticeable and correctable. Surface dispersal is also less expensive than piping. However, even when this method is effective, the water remains near the foundation. As a complement to surface dispersal, the underground system channels the water away from the foundation through a network of subterranean pipes.

The function of a drainage system is to remove water from the soil surrounding a building, while concurrently filtering or preventing movement of soil particles. In the past, removal of ground water and relief from hydrostatic pressure have been accomplished by underground drainage systems which include porous or perforated pipes, such as PVC, and gravel or crushed rock. In these drainage systems, gravel or crushed rock is placed over and around the pipe to relieve hydrostatic pressure and to direct the ground water to the perforated pipe. A filter fabric is placed on top of the gravel to prevent soil from mixing with the gravel and clogging paths to the perforated pipe. Backfill is then placed on top of the filter fabric and in the area next to the subterranean wall.

The filter fabric mentioned above is usually referred to in the art as a geotextile and is typically made up of non-woven fibers, such as polypropylene. The fibers are melted and extruded into continuous filaments, and are then formed into layered sheets and punched with barbed needles that entangles the filaments into a strong bond.

Problems have arisen in connection with the above described conventional drainage system. First, gravel or crushed rock is not readily available in all locals and may be expensive to transport to job sites. Additionally, gravel and crushed rock are heavy and somewhat burdensome and expensive to install at a job site. Finally, the geotextile fabric can be dislodged when placing backfill over the fabric, allowing possible mixing of the dirt and gravel. Dirt may then enter and clog the perforated pipes, thereby rendering the drainage system nonfunctional and providing no relief from hydrostatic pressure to the subgrade walls. Clogging remains a problem even when the system is carefully designed with the particle size distribution of filter media and aggregate media properly matching the native soil in the region to be drained.

Most current drainage systems utilizing geotextile wraps over gravel cores still require careful design and labor intensive installation procedures.

Subterranean drainage quilts are prefabricated and offer many advantages over the gravel/covering systems, including ease of installation and reduction of cost. A number of prior art prefabricated systems have been developed which utilize vertical fins comprising open plastic core surrounded by polymer filter fabric to intercept and channel the underground water into drainage pipes.

Such systems offer substantially more reliable drainage systems, but these systems are hampered by the need for careful installation and labour intensive on-site assembly of the drainage fins and the tubing into continuous lengths. The drainage tube necessarily incorporated into the system is an additional cost component, because the filter cloth covered fins themselves do not provide enough built-in flow capacity, when subjected to lateral soil pressure to conduct water away from the site quickly, without the provisions of the additional pipe or conduit.

Hence, the use of such systems has been restricted to specialized drainage situations where higher on-site installed costs can be tolerated.

A septic tank system receives all waste fluid from a house or small building and delivers the waste fluid to a septic tank. The septic tank then breaks down the waste fluid to liquified sewage and other wastewater by utilizing either anaerobic or aerobic bacteria. The liquified sewage is then piped from the septic tank via drain lines to a leaching field, where the liquid is dispersed into an absorption field.

The pipes which carry the liquid from the septic tank to the leaching field are perforated or porous, such as PVC, and are conventionally surrounded by a mineral aggregate, such as gravel.

The subterranean drainage systems, as described above, may be used in connection with a septic system; however, the aforementioned problems associated with present subterranean drainage systems remain.

The difficulties suggested in the preceding are not intended to be exhaustive but rather are among many which may tend to reduce the effectiveness of prior drainage systems. Other noteworthy problems may also exist; however, those presented above should be sufficient to demonstrate that drainage systems appearing in the past will admit to worthwhile improvement.

OBJECTS and BRIEF SUMMARY OF THE INVENTION

Objects

It is therefore a general object of the invention to provide a novel drainage quilt for use in conjunction with a subterranean drainage system which will obviate or minimize difficulties of the type previously described.

It is a specific object of the invention to provide a drainage quilt which will reduce hydrostatic pressure when positioned adjacent a subterranean wall.

It is another object of the invention to provide a drainage quilt which will prevent soil from entering porous or apertured fluid handling conduits used in conjunction with conventional subterranean drainage systems.

It is still another object of the invention to provide a drainage quilt which is flexible and may therefore be used in conjunction with varying shaped pipes.

It is a further object of the invention to provide a drainage quilt which is lightweight and therefore easy to transport and install.

It is yet a further object of the invention to provide a drainage quilt which will withstand sufficient compression loading from backfill to meet the drainage requirements of the site.

It is still a further object of the invention to provide a drainage quilt which will not degrade in situ and is biocompatible with chemicals in the soil.

It is yet another object of the invention to provide a drainage quilt which is inexpensive to produce, easily manufactured and recycles in a unique manner materials that would otherwise be disposed of in land fills or create disposal problems such as old rubber tires and certain plastics.

BRIEF SUMMARY OF A PREFERRED EMBODIMENT OF THE INVENTION

A preferred embodiment of the invention which is intended to accomplish at least some of the foregoing objects comprises a drainage quilt which operably rests adjacent to a subterranean conduit and facilitates water removal and dispersal from underground drainage sites. The drainage quilt includes a water permeable membrane configured in a generally rectangular container and a plurality of drainage members disposed within the container. The water permeable membrane is composed of a filter fabric and operably restricts earth fines from transversing the membrane. The container includes generally rectangular first and second surfaces, which oppose each other, and four side surfaces perpendicularly connected to the first and second surfaces to achieve the rectangular shape.

The drainage members are composed of cubes of expanded polystyrene, chunks of old rubber tires or other non ground polluting material and are positioned in a homogeneous fashion to create drainage paths through the subject quilt. These elements serve to increase the relative area of drainage delivered to a subterranean pipe. The drainage members may be fabricated in varying sizes to increase void space between adjacent members or for ease of handling.

Flexible positioning ties extend perpendicularly through the first and second surfaces of the drainage quilt and serve to retain the relative positioning of the drainage members. The ties prevent the drainage members from assembling at any one area of the drainage quilt and thus encourage an equal distribution of fluid flow throughout the quilt. This effect could also be achieved by stitching the filter fabric in the shape of adjacent tubes.

THE DRAWINGS

Other objects and advantages of the present invention will become apparent from the following detailed description of a preferred embodiment thereof taken in conjunction with the accompanying drawings, wherein.

DETAILED DESCRIPTION

Context of the Invention

Figure 1:
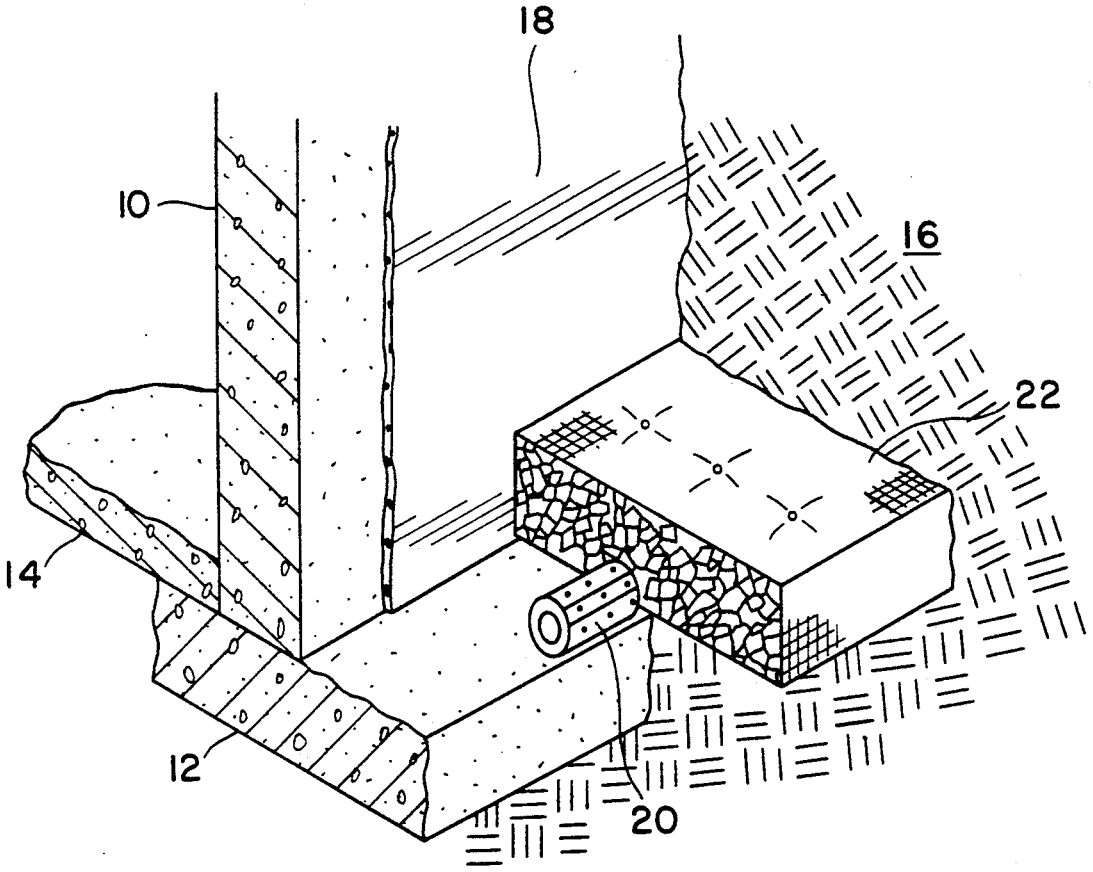
FIG. 1 is an axonometric view disclosing a context of the subject invention and depicts a subterranean building wall and a drainage quilt of the instant invention positioned between a drainage pipe and the surrounding earth.

Before discussing in detail a preferred embodiment of the subject drainage quilt, it may be useful to briefly outline an operative environment of the invention. Referring now to the drawings, wherein like numerals indicate like parts, and initially to FIG. 1, there will be seen an operative context of the subject invention. In this connection, FIG. 1 shows a detailed axonometric view of a subterranean wall 10, which may be composed of cinder block, poured or precast concrete, or the like. Such subterranean walls typically comprise foundations for residential and commercial buildings and rest upon a footer 12. An interior floor 14, typically composed of concrete, extends within the subterranean wall 10. Soil or porous backfill material 16 surrounds the wall 10 and is generally moisture laden. The exterior side of the wall 10 is waterproofed, to a degree, by a coating 18 composed of bituminous or sheet membrane waterproofing material.

In order to reduce hydrostatic pressure buildup on the exterior surface of the wall 10, a perforated or porous drainage pipe 20 rests on the footer 12 to collect ground water and drain the water to a peripheral location.

As a substitute for a crushed rock or gravel bed currently used in the construction industry, a drainage quilt or mat 22 of the instant invention is shown in an operative posture adjacent to the drainage pipe 20 and beneath the backfill 16. The drainage quilt 22 facilitates the passage of ground water from the backfill 16 to the drainage pipe 20, which drains the water away from the building foundation. In this context, the drainage quilt reduces the hydrostatic pressure adjacent the wall 10 and alleviates the problems described above in connection with conventional construction practice. The detailed structure and advantages of this novel drainage quilt will be discussed in detail below.

Drainage Quilt

Figure 2:
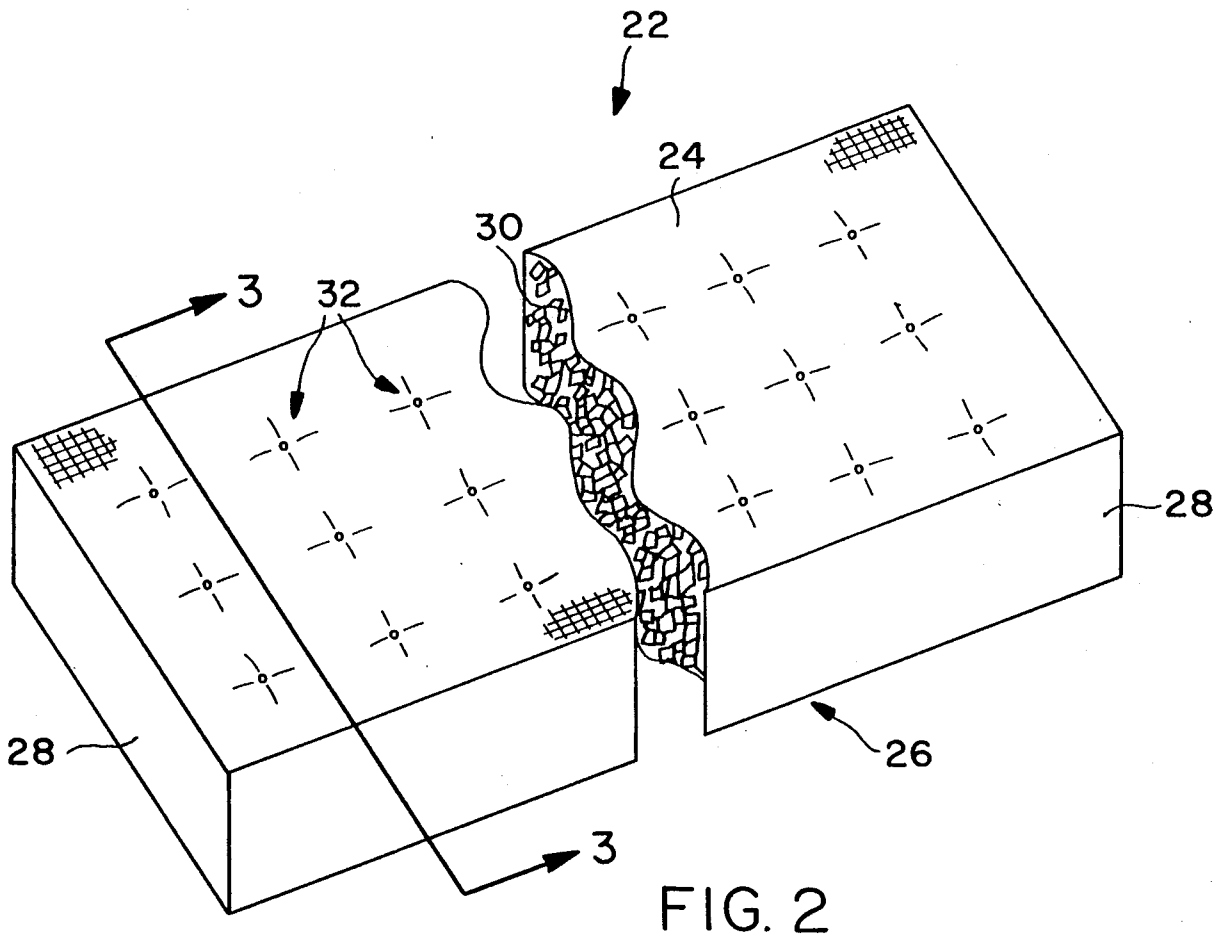
FIG. 2 is a detailed axonometric view of a drainage quilt in accordance with the subject invention.

Turning now to FIG. 2, shown is a detailed broken-away axonometric view of the subject drainage quilt 22. The drainage quilt 22 includes a first surface 24, a second surface 26 (not shown), and four side surfaces 28. In a preferred embodiment, the surfaces of the drainage quilt 22 are sewn together with thread or wire or alternatively stapled together to form a generally rectangular container. The standard dimension of the drainage quilt is approximately 10'×3'×1', though any dimension is possible depending on the requirements of the drainage system to be built.

The first 24 and second 26 surfaces and side surfaces 28 of the drainage mat 22 are composed of a flexible, water permeable membrane which restricts earth fines from entering the quilt 22. The membrane may be composed of one of any of the approximately two hundred available geotextile filter fabrics currently available in the market.

The drainage quilt 22 is filled with drainage members 30 composed of expanded or extruded polystyrene. The drainage members 30 fill the drainage quilt 22 in a generally homogeneous fashion so that sufficient void spacing is provided to permit the flow of water or other fluids through the quilt 22. While a cubical configuration for the drainage members is preferred, other three dimensional configurations are contemplated by the subject invention such as solid rectangles or other polyhedron configurations and the like as desired. In addition, materials other than polystyrene may be used in practicing the invention, such as polyisocyanurate, polyurethane, phenolic and the like. The drainage members may be fabricated with other materials, such as various recycled plastics, consistent with the requirements that chunks of used rubber tires, and the like, the material does not deteriorate when buried, is compatible with chemicals in the soil, is nonpolluting, and can withstand compression pressure from the backfill. Moreover, the size of the drainage members may be varied with different drainage quilts, or further within an individual drainage quilt, depending upon the desired drainage capabilities. However, it has been determined that optimum drainage results are achieved when the drainage quilt is fashioned with members having a cubic volume ranging from 0.125 to 3.375 inches cubed, with an average-sized cube having a 1"×1"×1" dimension.

Figure 3:
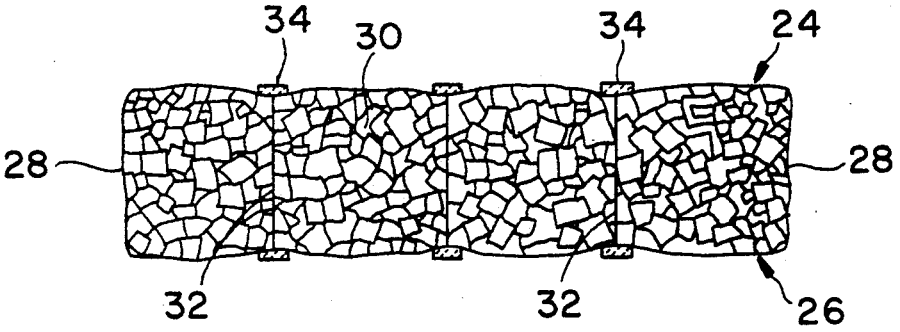
FIG. 3 is a detailed cross-sectional view of the subject drainage quilt, as taken along line 3—3 in FIG. 2.

Referring particularly to FIG. 3, there will be seen a cross-section of the subject drainage quilt 22 as taken along line 3—3 in FIG. 2. Positioning ties 32 extend from the first surface 24 of the drainage quilt 22 through the drainage members 30 to the second surface 26 and serve to retain relative positioning of the drainage members 30. The positioning ties 32 are fastened at approximately 12 inch centers with respect to the drainage quilt 22 by buttons 34, which are anchored at both the first 24 and second 26 surfaces, as shown. The positioning ties 32 are composed of a flexible, yet strong, material such as wire or heavy-duty string. The buttons 34 may be composed of plastic, wood, ceramic, or any other suitable material which prevents the positioning ties 32 from pulling through the drainage quilt 22.

In an alternative embodiment, the drainage quilt 22 is sewn in longitudinal tubes to maintain the generally homogeneous arrangement of drainage members.

Figure 4:
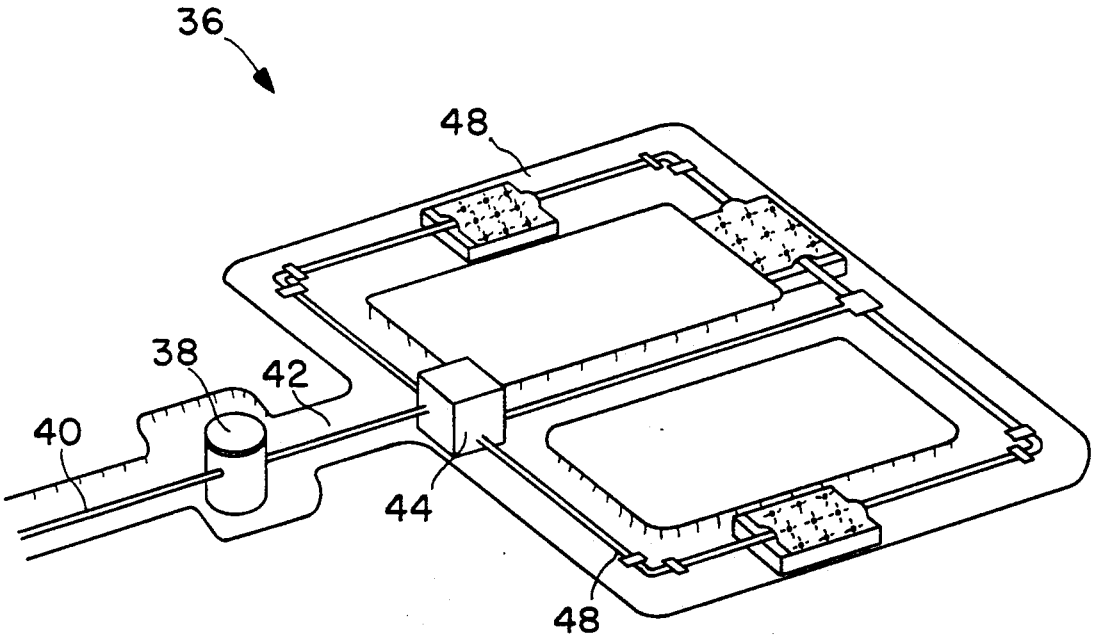
FIG. 4 is a partial broken-away plan view disclosing another context of the invention and depicts the subject drainage quilt as utilized in a septic system.

Turning now to FIG. 4, another operative context of the drainage quilt 22 is shown. A septic system 36 includes a septic tank 38 which is fed sewage from a house through a sewage line 40. The liquified sewage then flows through a drainage line 42 to a distribution tank 44 which in turn reroutes the wastewater into a leaching field through perforated drainage lines 46. Drainage quilts 22 of the present invention may be placed adjacent the drainage lines 46 to create drainage channels away from the lines 46 and to prevent earth fines from entering the perforated drainage lines.

SUMMARY OF MAJOR ADVANTAGES OF THE INVENTION

After reading and understanding the foregoing inventive drainage quilt, in conjunction with the drawings, it will be appreciated that several distinct advantages of the subject invention are obtained.

Without attempting to set forth all of the desirable features of the instant drainage quilt, at least some of the major advantages of the invention include an aggregate of drainage members 30 disposed within a water permeable membrane in a generally homogeneous arrangement. This arrangement creates random void spacing between the drainage members 30 to permit the passage of ground water. When the drainage quilt 22 is placed adjacent a drainage pipe, as shown in FIG. 1, water may flow through the quilt 22 to reduce hydrostatic pressure build-up at the foundation of a building.

The water permeable feature of the quilt prevents earth fines from transversing the quilt and entering a perforated drainage pipe which would clog a subterranean drainage system. In this connection, a geotextile filter fabric is used to construct a generally rectangular container, readily permitting water to traverse the membrane and percolate through the drainage members 30.

In a preferred embodiment, the drainage members 30, which comprises the bulk mass of the drainage quilt, are composed of recycled expanded polystyrene, recycled chunks of rubber tire material, etc. Due to the composition of the drainage members 30, the drainage quilt is flexible and easy to install and transport. Further, the drainage members 30 will withstand compression loading from backfill sufficient to permit drainage.

Positioning ties 32 operably prevent the drainage quilt 22 from loosing shape or becoming bag-like by retaining the relative positioning of the drainage members 30.

In describing the invention, reference has been made to a preferred embodiment and illustrative advantages of the invention. Those skilled in the art, however, and familiar with the instant disclosure of the subject invention, may recognize additions, deletions, modifications, substitutions, and other changes which will fall within the purview of the subject invention and claims.

What is claimed is:

1. A drainage quilt for use in a subterranean drainage system or the like, said drainage quilt comprising:

a water permeable membrane being composed of a filter fabric which operably restricts earth fines from transversing said water permeable membrane, said water permeable membrane having, a first surface operable to be placed adjacent a subterranean drainage pipe, a second surface coextensive with said first surface and spaced from said first surface of said water permeable membrane, and side surfaces connected to said first and said second surfaces to form a container;

an aggregate of drainage members composed of recycled chunks of rubber tires operably disposed within said container between said first and said second surfaces of said water permeable membrane in a generally homogeneous arrangement to create random void spacing between said aggregate of drainage members which permits the tortuous passage of fluid through said drainage quilt, said thickness of said container formed by said first and said second surfaces and said side surfaces being substantially greater than the mean diameter of said drainage members; and flexible means for maintaining a substantially parallel spacing between said first and said second surfaces to retain the distribution of said drainage members in a relatively homogeneous fashion throughout said drainage quilt.

2. A drainage quilt as defined in claim 1 wherein:

said first and said second surfaces of said water permeable membrane being generally rectangular such that said container formed by said first and said second surfaces and said side surfaces has a generally rectangular configuration.

3. A drainage quilt as defined in claim 1 wherein:

said drainage members being cube-shaped.

4. A drainage quilt as defined in claim 3 wherein:

said drainage members having a cubic volume ranging from 0.125 to 3.375 inches cubed.

5. A drainage quilt as defined in claim 1 wherein said flexible maintaining means comprises:

at least one flexible positioning tie extending through and being essentially perpendicular to said first and said second surfaces of said water permeable membrane.

6. A drainage quilt as defined in claim 5 wherein said at least one flexible positioning tie comprises:

a plurality of flexible positioning ties being essentially perpendicular to said first and said second surfaces of said water permeable membrane and spaced essentially equidistant from one another.

7. A drainage quilt for use in a subterranean drainage system or the like, said drainage quilt comprising:

a water permeable membrane being composed of a filter fabric which operably restricts earth fines from transversing said water permeable membrane, said water permeable membrane having, a first surface operable to be placed adjacent a subterranean drainage pipe, a second surface coextensive with said first surface and spaced from said first surface of said water permeable membrane, and side surfaces connected to said first and said second surfaces to form a generally rectangular container;

an aggregate of drainage members composed of chunks of plastic and operably disposed within said container between said first and said second surfaces of said water permeable membrane in a generally homogeneous arrangement to create random void spacing between said aggregate of drainage members which permits the tortuous passage of fluid through said drainage quilt, said thickness of said container formed by said first and said second surfaces and said side surfaces being substantially greater than the mean diameter of said drainage members; and a plurality of flexible positioning means for maintaining substantially parallel spacing between said first and said second surfaces to retain the distribution of said drainage members in a relatively homogeneous fashion throughout said drainage quilt.

8. A drainage quilt as defined in claim 7 wherein:

said first and said second surfaces of said water permeable membrane being generally rectangular such that said container formed by said first and said second surfaces and said side surfaces has a generally rectangular configuration.

9. A drainage quilt as defined in claim 7 wherein:

said drainage members being cube-shaped.

10. A drainage quilt as defined in claim 9 wherein:

said drainage members having a cubic volume ranging from 0.125 to 3.375 inches cubed.

11. A drainage quilt as defined in claim 7 wherein said flexible positioning means comprise:

at least one flexible positioning tie extending through and being essentially perpendicular to said first and said second surfaces of said water permeable membrane.

12. A drainage quilt as defined in claim 11 wherein said at least one flexible positioning tie comprises:

a plurality of flexible positioning ties being essentially perpendicular to said first and said second surfaces of said water permeable membrane and spaced essentially equidistant from one another.

* * * * *